United States Patent [19]

Pearman et al.

[11] Patent Number: 4,930,488

[45] Date of Patent: Jun. 5, 1990

[54] PROCESSOR-CONTROLLED GAS APPLIANCES AND MICROPROCESSOR-ACTUATED VALVES FOR USE THEREIN

[75] Inventors: A. Noel J. Pearman, St. Paul; Gerald D. Hunter, Lino Lakes; Michael A. Woessner, Golden Valley, all of Minn.

[73] Assignee: Gas Research Institute, Chicago, Ill.

[21] Appl. No.: 233,523

[22] Filed: Aug. 18, 1988

[51] Int. Cl.[5] ..... F24C 3/00; F17D 3/00

[52] U.S. Cl. ..... 126/39 E; 126/39 BA; 251/11; 137/624.11

[58] Field of Search ..... 126/39 E, 39 G, 39 BA, 126/52; 251/129.01, 129.04, 129.05, 11; 236/1 A, 20 A, 14, DIG. 8; 431/18; 137/614.14, 624.11; 340/365 S, 711, 286 M, 286 R, 286 M, 712, 365 R

[56] References Cited

U.S. PATENT DOCUMENTS 3,852,728 12/1974 Flagg, Jr. .
4,125,357 11/1978 Kristen et al. .
4,341,197 7/1982 Butts .
4,391,265 7/1983 Chen .
4,454,501 6/1984 Butts .
4,492,336 1/1985 Takata et al. .
4,505,300 3/1985 Jaeger .
4,558,300 12/1985 Goldman ..... 340/286 M
4,688,547 8/1987 Ballard et al. ..... 236/DIG. 8

*Primary Examiner*—Larry Jones
*Attorney, Agent, or Firm*—Mason, Fenwick & Lawrence

[57] ABSTRACT

A microprocessor-controlled gas appliance basically comprising three components: (1) a computer processor with a sensor interface, (2) a valve assembly, and (3) a human interface. The sensor interface is capable of passing the input from a series of sensors through the processor for subsequent use in controlling the operation of a burner valve in the valve assembly. Appropriate sensors are provided for connection to the sensor interface to measure, among other things, flame temperature, gas flow, carbon monoxide, combustibles, occupancy by an individual in the presence of the gas appliance, and gas composition. The valve controls the flow of natural gas through a line from a source of gas to a burner found in the appliance. The valve is controlled through a valve operator that responds to signals obtained from the computer processor via valve interface electronics. The valve, valve operator and valve interface electronics together form the valve assembly which the second basic component of the microprocessor-based system. The third component of the system provides a way for the human user to interact with the gas appliance control system. In this regard, there is provided a visual display and a keypad input device.

14 Claims, 5 Drawing Sheets

PROCESSOR-CONTROLLED GAS APPLIANCES AND MICROPROCESSOR-ACTUATED VALVES FOR USE THEREIN

BACKGROUND OF THE INVENTION

1. Field of the Invention

The present invention relates to a microprocessor-controlled gas appliance, in general, and to a microprocessor-controlled residential gas range, in particular.

In the present invention, a microprocessor is used to control a burner valve and other operating systems of the residential gas range. The microprocessor is also used to provide a number of different features. For example, a temperature sensor is used to monitor cooking pan or pot temperature for precise control and temperature ramping. Provision is made for ignition and flame-proving. It is contemplated that there will be a host of alarms to take care of gas system failure and gas leaks. Carbon monoxide, combustibles, occupancy and smoke detectors are also included.

2. Background Art

In general, gas appliances have not kept pace with their electrical counterparts in terms of the extended functionality afforded by the use of microprocessor-based control. One reason for this is the lack of an inexpensive and reliable microprocessor-controllable gas valve that can be incorporated into such devices as clothes dryers, commercial cooking equipment, warm air furnaces and domestic cooking appliances.

In clothes dryers, the ability to modulate the gas flame would add the benefit of shorter drying cycles. With regard to commercial cooking equipment, modulation of the gas flame has the advantage of tighter control of temperature in such appliances as ovens and deep-fat fryers. With regard to warm air furnaces, a controllable gas valve would form the heart of an advanced control system.

Finally, in the area of domestic cooking appliances, such as gas ranges, there is a need for gas flame modulation as well as enhanced functionality of the range. At the present time, residential gas ranges do not take advantage of the convenience, flexibility and safety possible through advanced microprocessor-based technologies.

Most cooking appliances produced today include more than one cooking station in the same appliance, often with several functions being available for one or more of the different cooking stations. For example, a single cooking appliance may include four burners or other surface heating elements at one cooking station, and a conventional oven at a second. The oven may be capable of baking, broiling, as well as other functions.

In order to enter cooking control information such as the temperature and the time for each of the various cooking functions of such multi-function appliances, a fairly complicated control panel has conventionally been required. Typically an analog control knob for entering times and temperatures is associated with each group of cooking station controls. Normally, only a frequent user of the appliance is able to enter the more common cooking control information for the oven without consulting an instruction book.

U.S. Pat. Nos. 4,341,197 (Butts) and 4,454,501 (Butts) relate to a control arrangement for a multi-function cooking appliance which has a plurality of cooking stations. The control arrangement includes a control panel having a group of keys for entering control information for the stations and functions of the cooking appliance and a prompting device for messages which assist in entering the control information. These two patents disclose a control system in the context of an electric range and, therefore, offer no disclosure or insight into a microprocessor-based residential gas range employing computer-controlled gas flow valves.

U.S. Pat. No. 4,492,336 (Takata et al) relates to an automatic temperature control system employing a gas burner. As part of the control system is a solenoid valve and a proportional control valve that is adjusted through a temperature sensed by a temperature sensor and processed by dedicated electronic circuitry.

U.S. Pat. No. 4,391,265 (Chen) relates to a gas range that is controlled through a keypad or touch plate and includes a motor driven valve that contains a plurality of channels of different sizes. The motor driven valve is placed within a gas line to adjust the amount of gas directed to a burner of the gas range.

U.S. Pat. No. 4,125,357 (Kristen et al) relates to an electronic control system and a gas range for controlling gas burners in four ways. The control system accomplishes the following four functions: (1) initial ignition of the gas, (2) continued combustion of the gas, (3) time rate averaging at which gas is burned, and (4) temperature maximization of the combustion chamber.

U.S. Pat. No. 4,505,300 (Jaegar) relates to a control valve apparatus including a modulating valve for controlling the amount of gas or fluid passing through a line. The valve accomplishes modulation through the use of a multiplicity of valve seats, springs and sliding elements.

U.S. Pat. No. 3,852,728 (Flagg, Jr.) is cited merely to show the incorporation of a warning device to indicate that the burners of an electric range are hot.

As pointed out in the Kristen et al patent, in the general field of gas burners, ignition safety devices and devices for effecting a maximum temperature limitation, typically take the form of separate devices for each separate task. In addition, yet another separate device is generally employed for regulating the average energy output of the unit. Some ignition safety and flame monitoring devices employ photoelectric cells and ionization sensors for checking the flame. Other devices operate with a bi-metallic element which operates in conjunction with a pilot flame. In still other cases, gas valves may be directly driven by thermo-sensitive elements. Typically, the maximum temperature control function is performed by rod expansion switches or by bi-metal switches. The average energy output of the burner is typically controlled by bi-metal switches or use liquid expansion switches or gas expansion switches, and with apparatus for operating the burner on a time-pulsed basis, independently of the burning chamber temperature.

Thus, there is a need for a gas appliance incorporating a microprocessor-controlled valve for controlling each burner to achieve specific setpoints versus time. There is also a need for a gas appliance which incorporates a temperature sensor used to monitor the temperature of interest, such as cooking pan or pot temperature in the case of a gas range. Further, there is a need for a gas appliance that makes use of gas sensing to operate alarms in case of system failures and gas leaks. There is also a need for gas appliances which are capable of interaction with microprocessor-based systems outside of the appliance itself. The present invention is directed toward filling these needs.

SUMMARY OF THE INVENTION

The present invention relates to a microprocessor-controlled gas appliance, in general, and to a microprocessor-controlled residential gas range, in particular. The teachings of the present invention are also applicable to such gas appliances as clothes dryers, commercial cooking equipment, warm air furnaces and domestic cooking appliances.

In its most basic form, a preferred embodiment of the present invention basically comprises three components: (1) a computer processor with a sensor interface, (2) a valve assembly, and (3) a human interface. The sensor interface is capable of passing the input from a series of sensors through the processor for subsequent use in controlling the operation of a burner valve in the valve assembly. Appropriate sensors are provided for connection to the sensor interface to measure, among other things, flame temperature, gas flow, occupancy by an individual in the presence of the gas appliance, and gas composition.

The valve controls the flow of natural gas through a line from a source of gas to a burner found in the appliance. The valve is controlled through a valve operator that responds to signals obtained from the computer processor via valve interface electronics. The valve, valve operator and valve interface electronics together form the valve assembly which is the second basic component of the microprocessor-based system.

The third component of the system provides a way for the human user to interact with the gas appliance control system. In this regard, there is provided a visual display and a keypad input device.

Also forming part of the present invention is a microprocessor-actuated gas valve. A preferred embodiment of the valve consists of a cylindrically-shaped, hollow aluminum housing body that terminates at one end in a coupling for connection to one end of a gas line. The coupling contains a through-bore which provides a passage for gas from the gas line into the interior portion of the housing. The other end of the main housing body receives a generally cylindrically-shaped valve cap that is secured to the main housing body. The outer surface of the aluminum valve cap contains a cylindrical projection which receives a brass orifice that contains a through-bore that serves as an output for gas received within the valve from the source of gas.

The valve cap secured to the main housing body defines an enclosed interior cylindrically-shaped chamber. This chamber receives a cylindrical sleeve made of soft magnetic iron that is positioned to circumscribe the interior wall of the housing. Also positioned within the housing in contact with the magnetic sleeve and in mating relationship with the interior surface of the valve cap is a magnetic washer also made of a soft magnetic iron.

A coil assembly, positioned within the vacant area defined inside of the magnetic sleeve, includes a spool-shaped bobbin preferably made of Lexan and holding a coil formed by copper wire.

A cylindrically-shaped elongated brass sleeve, received within the interior of the spool defined by the bobbin, receives a poppet assembly that in a preferred embodiment is made of a soft magnetic iron. The poppet assembly terminates at one end in a flat portion to which forms a sealing surface. When the poppet is positioned as close as possible to the connector, the tape seal closes off the passage of gas through the channel. A spring made of phosphor-bronze wire is positioned within the poppet assembly and the valve cap in order to force the poppet assembly in the direction of sealing the channel. Application of an electric current through the leads activates the coils in order to cause the poppet assembly to move in a direction toward the orifice.

It is thus a primary object of the present invention to provide an improved microprocessor-controlled gas appliance.

It is another object of the present invention to provide a microprocessor-controlled residential gas range.

It is yet another object of the present invention to provide a microprocessor-actuated valve to control the flow of fluid and air to both atmospheric and powered-type natural gas appliances.

It is still another object of the present invention to provide a residential gas range incorporating a microprocessor to control a burner valve in order to control various operating conditions of the range.

It is a further object of the present invention to provide a gas range possessing extended functionality afforded by the use of microprocessor-based controls.

These and other objects and advantages of the present invention will become apparent upon reading of the following detailed description and upon reference to the drawings.

DETAILED DESCRIPTION OF THE PREFERRED EMBODIMENTS

Figure 1:
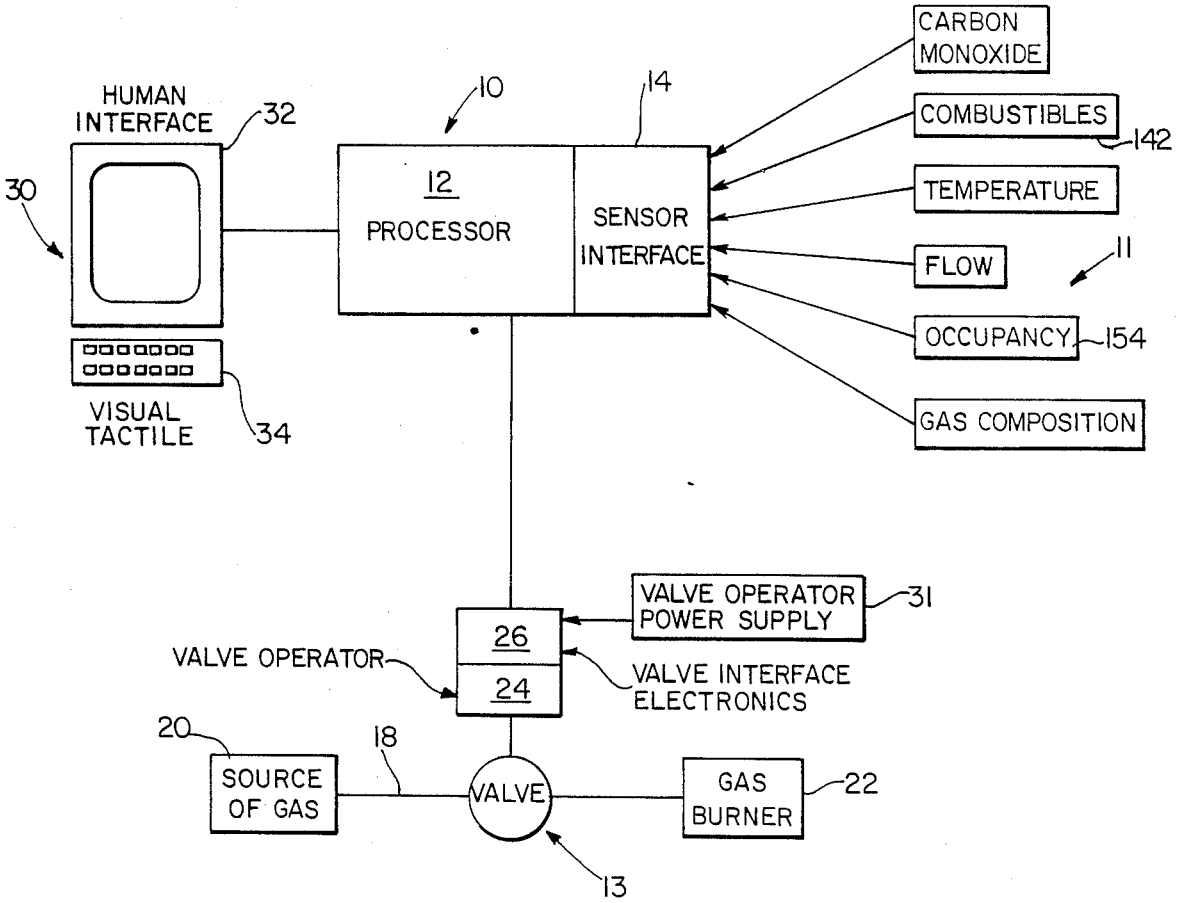
FIG. 1 is a schematic diagram showing a generalized representation of a gas appliance incorporating the teachings of the present invention.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 schematically illustrates the basic elements found in the present invention as incorporated into a generalized representation of a gas appliance. The system constituting the present invention is generally designated as 10, and contains the following three basic components: processor 12 with a sensor interface 14; a valve assembly 13; and a human interface 30. In a preferred embodiment, the processor is implemented through a commercially available, inexpensive microprocessor. The sensor interface 14 is capable of passing the input from a series of sensors through the processors 12 for subsequent use in controlling the operation of a valve 16 within the valve assembly 13. As shown in FIG. 1, appropriate sensors 11 are connected to the sensor interface to measure, among other things, flame temperature, gas flow, occupancy by an individual in the presence of the gas appliance and gas composition.

The valve 16 controls the flow of natural gas through line 18 from a source of gas 20 to a burner 22 found in the appliance. The valve 16 is controlled through a valve operator 24 that responds to signals obtained from the processor 12 via valve interface electronics 26. Both the valve operator and the valve interface electronics will be described in greater detail hereinafter. Suffice it to say at this point, that the valve interface electronics performs the function of translating the processor commands to the valve into actuation signals with sufficient power to command the valve operator.

The valve, valve operator and valve interface electronics form the valve assembly which is the second basic component of the microprocessor-based system.

The third component, generally designated as 30, provides a way for the human user to interact with the gas appliance control system. At the heart of the interface is a visual display 32 and a keypad input device 34. Both of these items will be described in greater detail hereinafter in connection with a specific embodiment of the invention incorporated into a residual gas range.

Figure 3:
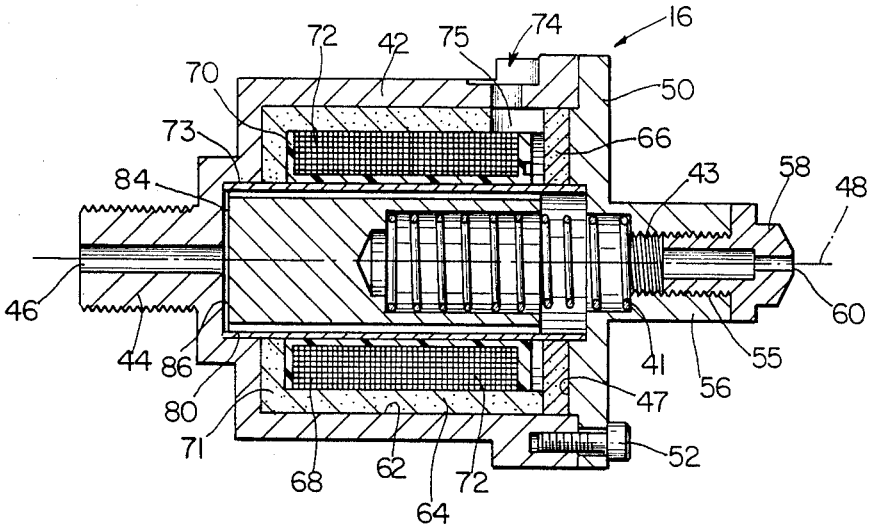
FIG. 3 is a cross-sectional view of the valve of FIG. 2.
Figure 2:
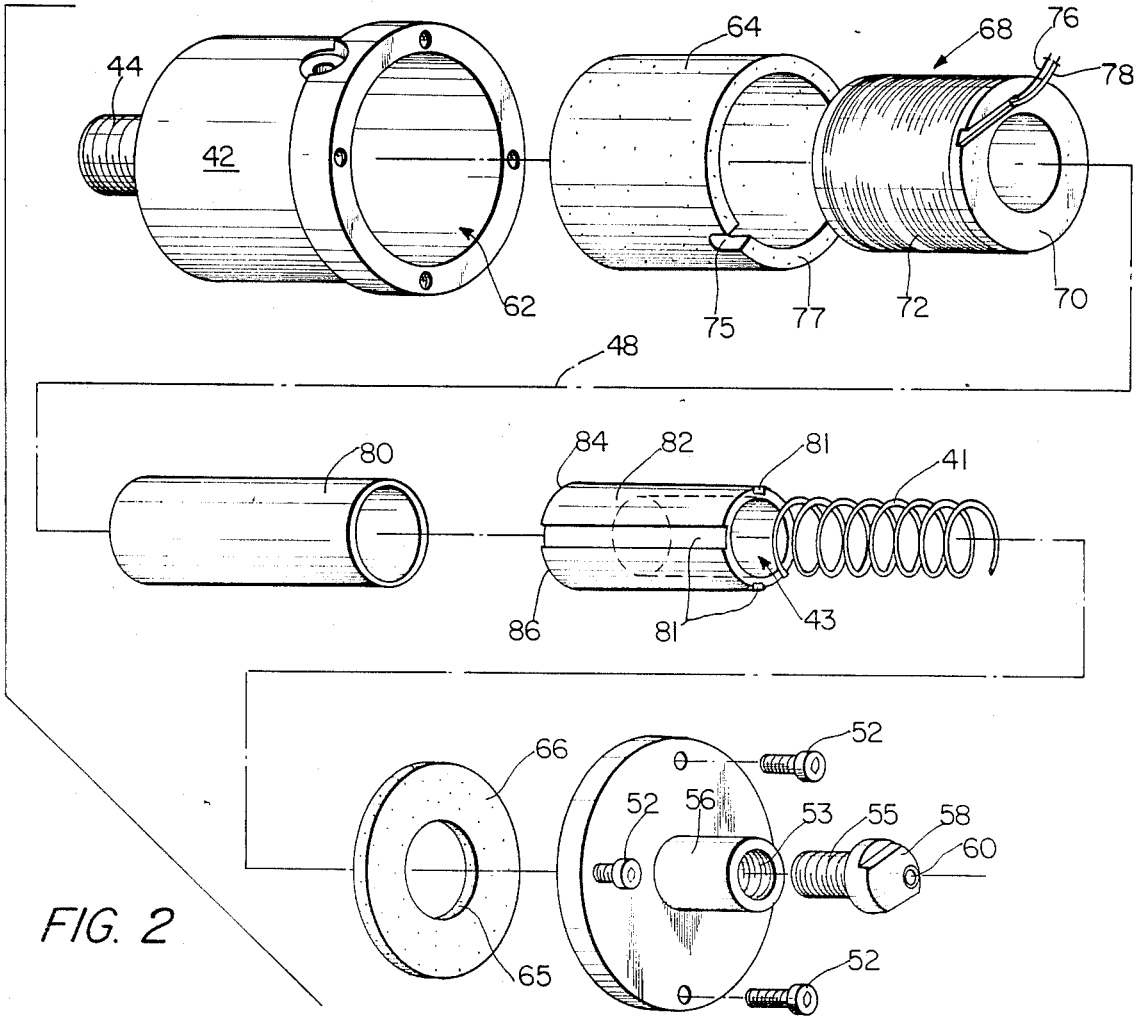
FIG. 2 is an exploded perspective view of a microprocessor-actuated gas valve incorporating the teachings of the present invention.

FIGS. 2 and 3 illustrate a preferred embodiment of a microprocessor-actuated gas valve suitable for use in the present invention. Of particular importance is that the valve is small enough so that it is compatible with residential range applications. The valve consists of a cylindrically-shaped, hollow housing body 42 that terminates at one end in an outwardly extending coupling 44 that is about 0.5 inches long for connection to one end of the gas line 18. Coupling 44 contains a through-bore 46 which provides a passage for gas from the gas line 18 into the interior portion of the housing 42. In a preferred embodiment, the housing, which is about 1.5 inches long and has an inner diameter of about 1.2 inches, is made of aluminum, for example. The coupling 44 and the through-bore 46 are defined to lie along the central longitudinal axis 48 of the main housing body. The other end of the main housing body receives a generally cylindrically-shaped valve cap 50 that is secured to the main housing body by means of appropriately placed fasteners such as Allen head screws 52. The outer surface 54 of the valve cap contains an outward cylindrical projection 56, of about 0.5 inches in length, that has internal screw threads 53 which mate with external threads 55 on a brass orifice 58. An appropriately sized through-bore 60 is defined in the orifice 58 as an output for gas received within the valve from the source of gas. Both the projection 56 and the orifice 58 are defined to lie along the central longitudinal axis 48 of the main housing body. As with the main housing body, the valve cap 50 in the preferred embodiment is made of aluminum.

The valve cap secured to the main housing body defines an enclosed interior cylindrically-shaped chamber 62. This chamber receives a cylindrical sleeve 64 that is positioned to circumscribe and make intimate contact with the interior wall of the housing body 42. The sleeve terminates at one end in a closed portion 71 that has defined therein a central aperture 73. The other end of the sleeve is open and has a groove 75 defined along the cylindrical surface of the sleeve at the periphery 77 of the open end. The groove 75 provides part of the passageway 74 for wire leads 76 and 78 which form part of a coil 72, the purpose of which will be described hereinafter. In a preferred embodiment, the sleeve, which has an inner diameter of about 1.0 inches, is made of a soft magnetic iron. Also positioned within the housing in contact with the magnetic sleeve and in mating relationship with the interior surface of the valve cap is a magnetic washer 66 also made of a soft iron and having a central aperture 65.

Before the magnetic washer and valve cap are fixed to the valve, a coil assembly 68 is positioned within the vacant area defined inside of the magnetic sleeve. The coil assemmbly, which constitutes the valve operation 24, includes a spool-shaped bobbin 70 preferably made of Lexan that contains in a preferred embodiment a coil 72 formed by wrapping 1500 turns of #25 copper wire. The leads constituting the ends 76 aand 78 of the coil 72 pass through a passageway 74 defined within the housing and are exposed to the exterior of the valve for connection to the valve interface electronics.

A cylindrically-shaped elongated brass sleeve 80 is received within the interior of the spool defined by the former 70. The brass sleeve 80 in turn receives a cylindrically-shaped poppet member 82, that in a preferred embodiment is made of a soft magnetic iron. The poppet assembly terminates at one end in a flat portion 84 which defines a seal 86. A series of four longitudinally extending grooves 81 are equally spaced about the exterior of the cylindrical surface of the poppet member. The several grooves function in conjunction with the interior surface of sleeve 80 as flow channels for gas passing from channel 46 to orifice 58. When the poppet is positioned as close as possible to the connector 44, the tape seal closes off and prevents the passage of gas through the channel 46. A spring 41 consisting of nine turns, for example, and made of phosphor-bronze wire is positioned within an evacuated portion 43 defined in the end of the poppet away from seal 86. A portion also resides in an indentation defined in the interior surface 47 of the valve cap in order to force the poppet assembly in the direction of sealing the channel 46. Application of an electric current from a power supply 31 through the leads 76 and 78 activates the coils 72 in order to cause the poppet assembly to move in a direction toward the orifice 58.

Figure 4:
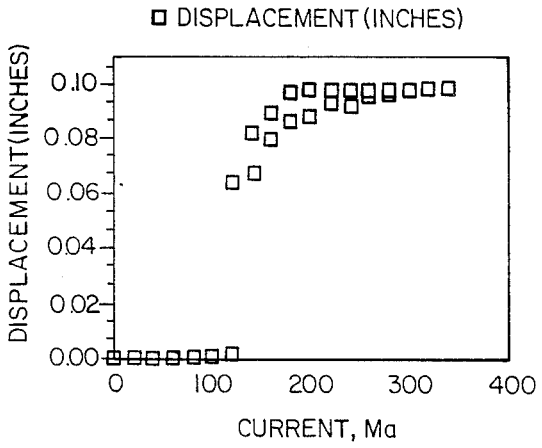
FIG. 4 is a graph showing valve displacement versus current for the valve shown in FIG. 2.

FIG. 4 shows the way in which the displacement of the poppet may be controlled through the application of current across coils 72. As can be seen, the amount of displacement may be changed in proportion to the amount of current supplied to the coil. The amount of displacement of the poppet assembly 84 thus controls the amount of gas passing from the source of gas through the gas line into the channel 46 through the interior of the sleeve 80 and out the orifice opening 60 for ignition. In this way, the rate of gas flow is controlled electrically. This is to be contrasted with the prior art where outlet gas pressure is regulated in response to variations in supply current.

Figure 5:
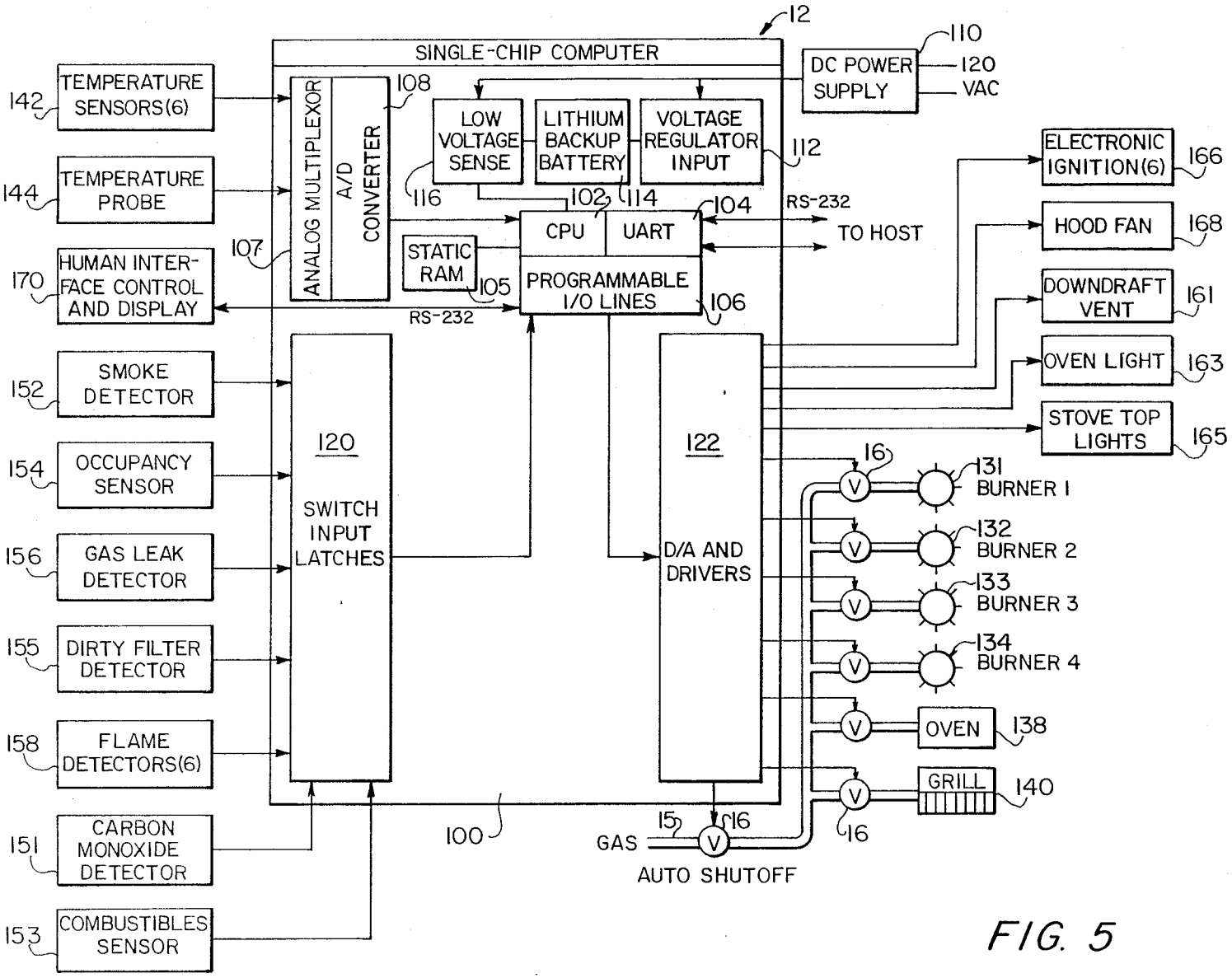
FIG. 5 is a schematic diagram showing a preferred embodiment of the present invention incorporated into a residential gas range.

FIG. 5 illustrates a schematic diagram of a system applying the teachings of the present invention to a residental gas range. At the heart of the system is the processor 12 which, in a preferred embodiment, consists of a Tattletale Model 4 microprocessor 100 sold by Onset Computer Corporation of Falmouth, Mass. The specific embodiment of the processor was selected because of its known small size and low cost.

The microprocessor or computer 100 includes a central processing unit (CPU) 102 based on a conventional 6301 processor. Interacting with the CPU 102 is a universal asynchronous receiver/transmitter (UART) 104 which is used to interface with a word-parallel controller or a data terminal to a bit-serial communication network. Through the use of a conventional RS-232 interface, the processor 12 can communicate with such remote devices as a host computer for the purpose of altering programs and data within the computer 100, as well as to interact with other external devices such as residential security systems and the like. Also associated with the CPU and the UART are sixteen programmable input/output lines 106, which can be programmed individually as inputs or outputs.

Associated with the CPU are 32K bytes of static RAM 105, 4K of which is used for system variables. The remaining 28K can be divided up in any way between program, array variables and data storage. Also interacting with the CPU is a 10-bit analog multiplexer 107 and an 11-channel A/D converter 108 designed to make conversions ratiometric to the computer's nominal 5 V supply.

The computer is powered by a 12 V DC supply 110 which is connected to a voltage regulator 112 contained within the computer. The regulator will accept a 7 to 12 V input and provides an average current of 20 mA and a fixed supply voltage of 5 VDC. The computer also includes a lithium battery back-up 114 to retain program and data, should the power source be removed or drop below 7 VDC. The placement of the lithium battery 114 into active operation is controlled through a low voltage sense 116, which receives and monitors the input voltage from the power supply 110.

The computer also includes a series of switch input latches 120 which receive digital signals from various types of sensors and detectors for passage through one of the programmable input/output lines 106. Finally, the computer also includes a digital-to-analog converter and current drivers 122 with the driver being associated with each of the control valves 16 described hereinbefore. The drivers essentially constitute the valve interface electronics 26.

Figure 6:
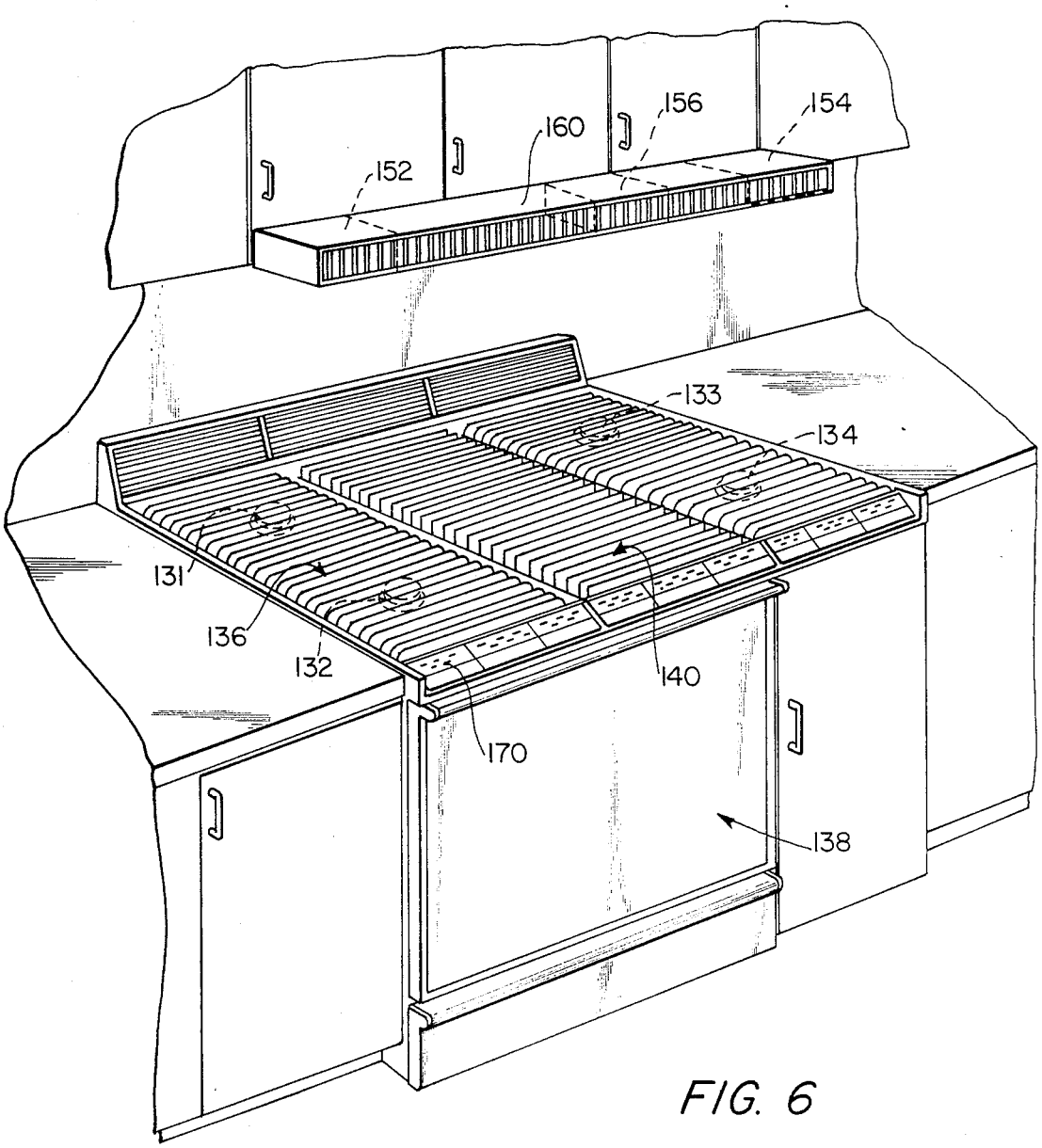
FIG. 6 is a generalized perspective view showing features of the present invention incorporated into a residential gas range of the type schematically shown in FIG. 5.

As shown in FIGS. 5 and 6, a preferred embodiment of the residental gas range consists of four burners 131 through 134 which are positioned about a cook top 136 in a conventional arrangement. Also included is a conventional gas oven 138 and a gas grill 140. The oven is positioned below the burners in a compartment especially provided for that purpose. The grill is positioned on the top 136 of the range between pairs of burners. The four burners, the oven and the grill, which collectively constitute gas burning devices, all produce gas flames which are used to accomplish various purposes. Each of the burners, oven and grill has associated with it the unique valve 16 which is controlled through control lines 121 provided to the valve operators 24 by the D/A and drivers 122.

Each of the gas burning devices has associated with it a temperature sensor 142 which is used to monitor the temperature of the flame produced in the burners, oven and grill. Temperature information for each of the sensors passes through the multiplexer 107 and the A-to-D converter 108 and into the central processing unit 102 to provide needed data for use in controlling the operation of the flame provided to each of the gas burning devices. In a preferred embodiment, the temperature sensor consists of a small platinum resistance clamp-on temperature sensor. One such sensor bears Product No. RTS-63 and is manufactured by Hy-Cal Engineering of Elmonte, Calif. The sensor generally operates in the −100° F. to +900° F. range, and is positioned in close proximity to the flame producing portion of the gas burning devices.

The gas range also includes the incorporation of a conventional temperature probe 144 which may be placed in an article of food in order to detect the internal temperature of the food and cause the gas range to respond in some fashion. As with the temperature sensors, the signal from the temperature probe passes through the analog multiplexer 107, the A-to-D converter 108 and into the CPU 102 for subsequent processing.

Also forming part of the gas range are several conventional detectors. FIG. 5 shows several examples of such detectors such as a smoke detector 152, an occupancy sensor 154, a gas leak detector 156, a dirty filter detector and several flame detectors 158. A flame detector is associated with each gas burning device to detect the presence or absence of a flame. One detector suitable for use in a preferred embodiment is that made by Honeywell Corporation under product designation C7000 Series Flame Detector. Also included in a preferred embodiment of the present invention are a carbon monoxide detector 151 and a combustibles detector 153. These devices may be incorporated, for example, into a range hood 160 (FIG. 6).

With reference to FIG. 6, a preferred embodiment of the present invention incorporates the conventional smoke detector 152 (in phantom) into the range hood 160 spaced above the cook top 136. The computer 100 also receives the analog output of the occupancy sensor 154 which may also be positioned within the range hood 160. The same may be said with respect to the gas leak detector 156. The flame detector 158 (FIG. 5), on the other hand, is located in close proximity to the flame produced by each of the burners, the oven and the grill.

With continued reference to FIGS. 5 and 6, the residential gas range also includes a conventional electronic ignitor 166, which is connected to the computer through the programmable input/output lines 106, and D/A converter and current drivers 122. The electronic ignitor is used to ignite the gas as it passes to each of the four burners, the oven and the grill by providing a spark to each burner. In an alternative embodiment, the ignitor associated with the four burners may be replaced by a single electronic ignitor that is equally spaced from the four burners. Completing the system is a variable speed hood fan 168 which is connected to the D-to-A and drivers 122, and is mounted within the hood 160 in order to exhaust contaminated air from around the appliance to the outside of the room in which the appliance is located. Other devices, such as a down-draft vent 161, oven light 163 and stove top lights 165, can be controlled by the computer 100. It is also contemplated that the residental gas range will include a master valve 15 under computer control that will shut off gas flow to the entire system.

Also included as part of the system is a keyboard touchpad 170 which, in a preferred embodiment, consists of a touch-sensitive screen for user-friendly interface and data access. One such screen found suitable for use in the present invention is that made by Kiel Corporation of Nassua, N.H. The touch-sensitive screen responds to user input by displaying interactive menus, specialized keyboards, as well as regular alpha/numeric keyboards.

The touchpad 170 includes several keyboard and sensor inputs. The touch screen of the touchpad is capable of displaying and providing notification of such items as the presence or absence of a flame at a particular location within the gas range, the temperature in the oven, including the broiler portion of the oven, the top burners, the grill and any flue gas passing out of an exhaust vent (not shown). The touch screen also contains keyboard inputs for burner control, desired heat or temperature level of the burners, oven and grill. Provision is also provided for timed operation values, delayed start and a warming request.

Figure 7:
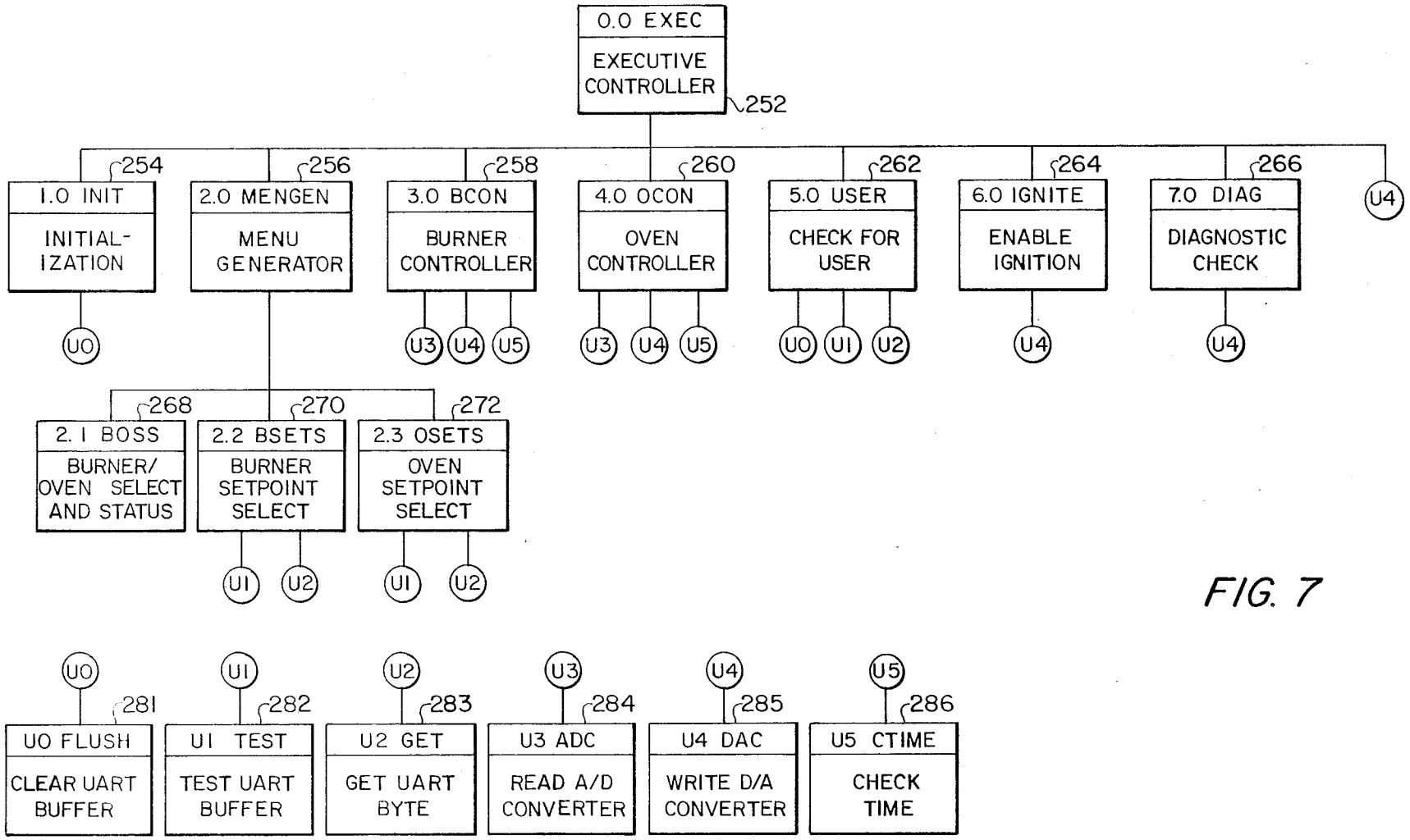
FIG. 7 is a chart showing interrelated software modules used in a preferred embodiment of the subject invention such as that schematically shown in FIG. 5.

In order to tie all of the functions of the microprocessor-controlled residential gas range together, a preferred embodiment of the subject invention incorporates a particular software system generally shown in FIG. 7. The software hierarchy is implemented in FIG. 7 through several interrelated modules. Each module performs a specific function to implement a required functionality of the residential gas appliance.

FIG. 7 schematically shows the interrelationship of the software modules. A first module, the Executive Controller 252, is denoted by the command EXEC. As can be seen in FIG. 7, the Executive Controller has direct control over several modules including Initialization, Menu Generator, Burner Controller, Oven Controller, Check for User, Enable Ignition and Diagnostic Check. By the same token, the Menu Generator software module has direct control over the Burner/Oven Select and Status (BOSS) 268, the Burner Setpoint Select (BSETS) 270 and the Oven Setpoint Select (OSETS) 272. The system of FIG. 7 shows the software control for the burners 131 through 134 and the oven 138. Additional modules patterned after the Oven Controller 260 and the Oven Setpoint Select 272 may be added to take care of additional devices such as grill 140.

Certain of the software modules carry out certain utility routines which are noted by blocks 281 through 286. These blocks relate to certain utility routines which are carried out within the computer in connection with the UART 104, the A-to-D converter 108 and the D-to-A converter 122, as well as the system time clock (not shown). The way in which the several utilities 281 through 286 relate to the several modules is denoted in FIG. 7 by a circular element with a letter and number inside. By way of example, the initialization routine at the appropriate time will call up the flush routine. This is denoted by the use of the circle with the symbol U0 inside.

Before discussing the program design logic associated with each module, the following variables and flags should be understood.

Variables

AIN—Analog Input Channel (0 to 9)
BMODE—Burner Operation Mode (0=OFF; 1=Manual; 2=Profile; 3=Interactive)
BSETPT—Burner Setpoint
BSET1—Burner Setpoint During Phase 1 Of Profile Mode
BSET2—Burner Setpoint During Phase 2 Of Profile Mode
BSTART—Burner Start Time Of Profile Mode
BSTEP—Burner Step Time Of Profile Mode
BSTOP—Burner Stop Time Of Profile Mode
BYTE—First Byte In UART Buffer
CS—Chip Select Control Lines For D/A Converters (0,1)
CTRL—Output Control Variable (0 to 255)
DIN—Digital Input Of A/D Converter
IE—Ignition Enable Control Lines
ISET—Discrete Burner Setpoint During Interactive Mode (0 to 10)
OMODE—Oven Operation Mode (0=OFF; 1=Manual; 2=Profile)
OSETPT—Oven Setpoint (0, 200, 225, 250, . . . , 500)
OSET1—Oven Setpoint During Phase 1 Of Profile Mode
OSET2—Oven Setpoint During Phase 2 Of Profile Mode
OSTART—Oven Start Time Of Profile Mode
OSTEP—Oven Step Time Of Profile Mode
OSTOP—Oven Stop Time Of Profile Mode Flags BI-FLAG—Burner Ignition Flag—set when burner has been ignited
BUF-FLAG—Buffer Flag—number of bytes in UART buffer
CHK-FLAG—Check Flag—set if time test true
OI-FLAG—Oven Ignition Flag—set when oven has been ignited The following is a presentation of pseudo-code which is the English language description of the functions to be performed by the various software modules. This pseudo-code can be readily translated to machine-recognizable instructions to implement the control, data management and human interface driver functions.

The Executive Controller 252 provides supervisory control for the entire system and includes ten levels of discrete valve control for the various burners and oven in the interactive mode. The following is the flow logic associated with the Executive Controller:

```
Begin
    Call INIT
    Call MENGEN mode 1
    DO FOREVER
        If (BMODE <> 0)
        Then If BI-FLAG = 0
                Then CS = 0
                    Call IGNITE
                    BI-FLAG = 1
                Endif
        If (OMODE <> 0)
        Then If OI-FLAG = 0
                    Call IGNITE
                    OI-FLAG = 1
                Endif
                Call OCON mode 1 or 2
                Endif
                Call USER
        If (BUF-FLAG <> 0)
        Then If (BYTE = "UP" OR BYTE = DOWN) AND
BMODE = 3
        Then If BYTE = "UP"
                Then ISET = ISET + 1
                Else ISET = ISET − 1
                Endif
                If ISET > 10
                Then ISET = 10
                Endif
                IF ISET < 1
                Then ISET = 0
                BMODE = 0
                BI-FLAG = 0
                Endif
```

-continued

```
            CTRL = ISET * (225/10)
            Call DAC
            Endif
        Else Call MENGEN mode BYTE
            Call MENGEN mode 1
            Endif
      Call DIAG
```

As can be seen, the Executive Controller 252 has the ability to call the software modules relating to initialization, menu generation, burner and oven control, user check, ignition enablement and diagnostics.

The Initialization Module 254 is called by the Executive Controller 252 to clear setpoints and display in the UART buffer 104. The Initialization Module also sets the control parameters and enables the user to set the system clock. The following flow logic is carried out by the Initialization Module:

```
Begin
        Clear all setpoints
        Clear all flags
        BMODE = OMODE = 0
        Clear display
        Set burner control parameters
        Set oven control parameters
        Call FLUSH
        Prompt for hours
        Prompt for minutes
        Set clock
        Initialize timer
        Return
End
```

The Menu Generator (MENGEN) 256 is called by the Executive Controller 252 as a way to further call the BOSS, BSETS and OSETS modules. The logic of the Menu Generator is as follows:

```
Begin
        Case : Mode
            1. Call BOSS
            2. Call BSETS
            3. Call OSETS
        Endcase
        Return
End
```

The BOSS 268 is called by the Menu Generator 256 to enable a user to select burner/oven control and to display burner/oven status on the touchpad 170. The function and logic associated with the BOSS is as follows:

```
Begin
    Clear display
    If BMODE = 0
    Then print burner = OFF
    Else print BMODE and (BSETPT or BSET1 or BSET2)
    Endif
    If OMODE = 0
    Then print oven = OFF
    Else print OMODE and (OSETPT or OSET1 or OSET2)
    Endif
    Print "Please select, burner or oven"
    Return
End
```

The Burner Setpoint Select (BSETS) 270 is called by the Menu Generator 256 to enable the user to select the burner mode (BMODE) and/or the burner setpoints. The functional logic for BSETS is as follows:

```
Begin
    Clear display
    Prompt for BMODE (0 = OFF; 1 = Manual; 2 =
    profile; 3 = interactive)
    CALL GET
    BMODE = BYTE
    Case : BMODE
        0.  BI-FLAG = 0
            BSETPT = 0
        1.  Prompt for setpoint
            Call GET
            BSETPT = BYTE
        2.  Prompt for start time
            Call GET
            BSTART = BYTE
            Prompt for start setpoint
            Call GET
            BSET1 = BYTE
            Prompt for step time
            Call GET
            BSTEP = BYTE
            Prompt for step setpoint
            Call GET
            BSET2 = BYTE
            Prompt for stop time
            Call GET
            BSTOP = BYTE
        3.  No operation
    Endcase
    Return
End
```

The Oven Setpoint Select (OSETS) 272 is called by the Menu Generator 256 to enable the user to select the oven mode (OMODE) and the oven setpoint. Its functional logic is as follows:

```
Begin
    Clear display
    Prompt for OMODE (0 = OFF; 1 = Manual; 2 =
    Profile)
    Call GET
    OMODE = BYTE
    Case : OMODE
        0.  OI-FLAG = 0
            OSETPT = 0
        1.  Prompt for setpoint
            Call GET
            OSETPT = BYTE
        2.  Prompt for start time
            Call GET
            OSTART = BYTE
            Prompt for start setpoint
            Call GET
            OSET1 = BYTE
            Prompt for step time
            Call GET
            OSTEP = BYTE
            Prompt for step setpoint
            Call GET
            OSET2 = BYTE
            Prompt for stop time
            Call GET
            OSTOP = BYTE
    Endcase
    Return
End
```

The Burner Controller (BCON) 258 is called by the Executive Controller 252 to set the appropriate analog input channel (AIN) as well as the chip select control lines for the D-to-A converters CS. The flow logic for this module is as follows:

```
Begin
        Set AIN, CS
        If BMODE = 2
        Then Call CTIME mode 1, 2 or 3 for state of profile
                BSTEP = 0; BSET1 or BSET2
        Endif
        Call ADC to input DIN
        Do closed-loop feedback control algorithm
        Call DAC to output CTRL
        Return
        End
```

The Oven Control (OCON) 260 is called by the Executive Controller 252 to once again set the appropriate analog input channel (AIN) as well as the chip select control lines (CS) when the oven mode is OMODE=1 or 2. The control logic associated with the OCON is as follows:

```
Begin
        Set AIN, CS
        If OMODE = 2
        Then Call CTIME mode 4, 5 or 6 for state of
        profile
                OSTEP = 0, OSET1 or OSET2
        Endif
        Call ADC to input DIN
        Do closed-loop feedback control algorithm
        Call DAC to output CTRL
        Return
End
```

The Check for User module (USER) 262 is called by the Executive Controller 256 to check if a user has made an input. The logic for this module is as follows:

```
Begin
        Call TEST
        If BUF-FLAG = 0
        Endif
        If BYTE is valid
        Return BUF-FLAG
        Else CALL FLUSH
        Return BUF-FLAG = 0
End
```

The Enable Ignition module (IGNITE) 264 is called by the Executive Controller 252 to set the ignition enable control line, i.e., for a number of seconds to be determined (TBD) and drives the selected burner or oven valve completely open to allow full admission. The logic associated with this module is as follows:

```
Begin
        Set IE
        CTRL = 255, CS = (0 = burner, 1 = oven)
        Call DAC
        Wait TBD seconds
        Clear IE
        Return
End
```

The Diagnostic Check (DIAG) 266 is called by the Executive Controller 252 to insure that if the burner operation mode (BMODE) or the oven operation mode (OMODE) is equal to 0, the appropriate valve is driven closed. The flow logic for this module is as follows:

```
Begin
        If BMODE = 0
        Then CTRL = 0, CS = 0
        Call DAC
        Endif
        If OMODE = 0
        Then CTRL = 0, CS = 1
        Call DAC
        Endif
        Return
End
```

With regard to the several utilities noted in modules 281 through 286, the logic associated with the Flush mode 281, which is used to clear the UART buffer 104 is as follows:

```
Begin
        Call &HFFE2*
        Return
End
```

*Note: FFE2 is the vector address for the subordinate routine.

The logic associated with the test module TEST 282 which returns the number of characters in the UART buffer 104 is as follows:

```
Begin
        Call &HFFD9*, BUF-FLAG
        Return BUF-FLAG
End
```

*Note: FFD9 is the vector address for the subordinate routine.

The logic associated with the GET module 283 which returns the next byte in the UART buffer is as follows:

```
Begin
        Call &HFFDC*, BYTE
        Return BYTE
End
```

*Note: FFDC is the vector address for the subordinate routine.

If the buffer is empty, it waits for the arrival of the next byte.

The ADC module 284 reads the selected analog channel input, AIN, and returns a 10-byte digital conversion, DIN. Its logic is as follows:

```
Begin
        DIN = CHAN(AIN)
        Return DIN
End
```

The DAC module 285 sets the chip select control lines (CS) and writes the CTRL to the selected D-to-A converter for output. The DAC logic is as follows:

```
Begin
        Set CS
        Convert CTRL to 8-bit representation
        Output representation to data bus
        Delay TBD milliseconds
        Clear CS
        Return
End
```

The Check Time module (CTIME) 286 compares current time with either the burner start time of the profile mode (BSTART), the burner step time of the profile mode (BSTEP) or the burner stop time of the profile mode (BSTOP). By the same token, it checks in the profile mode, the oven start time (OSTART), the oven step time (OSTEP) and the oven stop time (OSTOP) and returns an appropriate flag. The control logic associated with the CTIME module 286 is as follows:

```
Begin
    Case : mode
        1.  If current < BSTART
            Then CHK-FLAG = 0
            Else CHK-FLAG = 1
            Endif
        2.  If current < BSTEP
            Then CHK-FLAG = 0
            Else CHK-FLAG = 1
            Endif
        3.  If current < BSTOP
            Then CHK-FLAG = 0
            Else CHK-FLAG = 1
            Endif
        4.  If current < OSTART
            Then CHK-FLAG = 0
            Else CHK-FLAG = 1
            Endif
        5.  If current < OSTEP
            Then CHK-FLAG = 0
            Else CHK-FLAG = 1
            Endif
        6.  If current < OSTOP
            Then CHK-FLAG = 0
            Else CHK-FLAG = 1
            Endif
    Endcase
    Return CHK-FLAG
End
```

The various software modules are always available as long as power is being supplied to the processor system. To reset and start the processor, power from the power supply 110 is cycled to the computer 100. The system is configured so that an audio beep is heard from the display and a main menu is shown on the touch-sensitive screen of the touchpad 170 showing the mode and setpoint status of the selective controller. The controller is initialized and running.

To change the mode of operation for a burner or oven, a MODE? key located below the word BURNER or the word OVEN is pressed on the touch-sensitive screen 170. The specific arrangement of the keys and menus on the touch-sensitive screen changes from one embodiment of the invention to the next. Therefore, this portion of the present invention is discussed in the context of certain functions that are performed on the screen 170 without regard to the graphics used to implement the function. A new menu is displayed on the screen giving the user choices OFF, INPUT, PROFILE or INTERACTIVE modes of operation. A mode is selected by touching the desired mode key. The selected mode is now displayed on the top line of the touch-sensitive screen. If satisfied with the selection, the user touches the OKAY key on the lower right corner of the screen.

If OFF is selected, the inventive system 10 closes the appropriate valve 16 in the selected burner or oven and changes the setpoint to 0. If INPUT is selected, the system prompts the user with a numeric keypad by which the user can input a desired setpoint temperature in °F. If PROFILE is selected for timed temperature control, the touch-sensitive screen of the system prompts the user with MINUTES TO START, SETPOINT 1, MINUTES TO STEP, SETPOINT 2 and MINUTES TO STOP, in that order.

If INTERACTIVE mode is selected, the system implements OPEN MUTE CONTROL for four discrete control levels and a display with right and left arrows and levels 1 through 4 is shown on the main menu of the touch-sensitive screen. The current control level is displayed in reverse video. To change the control level, the user touches the appropriate right or left arrow key. Touching the left arrow key with a current control level of 1, changes the mode to OFF and shuts the valve currently in use. The INTERACTIVE mode is only available to the burners 131 through 134.

To change the control setpoints during the input and profile modes, the user touches the SETPT? key under the headings BURNER or OVEN displayed on the touch-sensitive screen. The controller then prompts the user with a numeric keypad. The user enters the desired setpoint and touches an ENTER key. If an error is made, a correction key CORR is available.

Thus, it can be seen that the preferred embodiment of the residential gas range provides the ability to control certain outputs of the range in a manner not heretofore contemplated. For example, through the use of the computer, the ignition of the various gas burning devices can be reliably and accurately controlled. Further, the amount of gas delivered to each gas burning device is easily controlled and modulated through the use of the microprocessor-actuated control valve 16. Timer operation is implemented to carry out any desired programmable functions.

The system also includes provision for safety and alarm functions as well as controlling devices related to the range such as the hood fan, hood lights and the oven light.

From the above, it is apparent that many modifications and variations of the present invention are possible in light of the above teachings. It is therefore to be understood that, within the scope of the appended claims, the invention may be practiced otherwise than as specifically described.

What is claimed is:

1. A gas appliance comprising:

a gas burner for burning gas and producing a flame;

valve means having an input port adapted to be connected to a source of combustible gas, and an output port, said valve means including a control means for controlling flow of said gas from the input port to the output port of said valve means;

means for conveying gas from said output port to said gas burner;

sensor means in close proximity to said gas burner for sensing a controllable characteristic of said flame; and computer control means responsive to said sensed controllable characteristic for providing a control signal, said control means responding to said control signal by changing the flow of gas through said valve means.

2. The gas appliance of claim 1, further comprising a key means for providing user commands to said computer control means to alter said control signal.

3. The gas appliance of claim 1, further comprising a detector means for detecting a predetermined characteristic of the area surrounding said appliance for producing a second control signal, said control means responding to said second control signal by changing the flow of gas through said flow means.

4. The gas appliance of claim 1, wherein said the sensor means comprises a temperature sensor in close proximity to said gas burner for sensing a temperature of said flame.

5. The gas appliance of claim 3, wherein the said detector comprises a smoke detector.

6. The gas appliance of claim 3, wherein the said detector comprises an occupancy sensor.

7. The gas appliance of claim 3, wherein the said detector comprises a gas leak detector.

8. The gas appliance of claim 3, wherein the said detector comprises a dirty filter detector.

9. The gas appliance of claim 3, wherein the said detector comprises a flame detector.

10. The gas appliance of claim 3, wherein the said detector comprises a carbon monoxide detector.

11. The gas appliance of claim 3, wherein the said detector comprises a combustibles sensor.

12. The gas appliance of claim 1, wherein the computer control means further comprises an interface adapted for connection to a host computer.

13. The gas appliance of claim 1, wherein said computer control comprise an interface adapted for connection with a security system.

14. A gas appliance comprising:

a gas burner for burning gas and producing a flame;

valve means having an input port adapted to be connected to a source of combustible gas, and an output port, said valve means including a control means for controlling flow of said gas from the input port to the output port of said valve means, wherein said control means comprises:

(1) a hollow chamber defined between said input and output ports;

(2) a poppet slidably mounted in said chamber, said poppet terminating at one end in a seal for closing off said input port when said poppet is in a first extreme position;

(3) spring means for normally moving said poppet to said first position so that gas does not normally flow from said input port to said hollow chamber; and (4) electrical activation means for moving said poppet means in a direction away from said input port, the amount of movement of said poppet being related to the strength of an electrical signal applied to said activation means;

means for conveying gas from said output port to said gas burner;

sensor means in close proximity to said gas burner for sensing a controllable characteristic of said flame; and computer control means responsive to said sensed controllable characteristic for providing a control signal, said control means responding to said control signal by changing the flow of gas through said valve means.

* * * * *